US006579464B2

(12) United States Patent
Cotte et al.

(10) Patent No.: US 6,579,464 B2
(45) Date of Patent: Jun. 17, 2003

(54) FIXTURES FOR PROCESSING A WORKPIECE IN A SUPERCRITICAL FLUID

(75) Inventors: John Michael Cotte, New Fairfield, CT (US); Matteo Flotta, Central Valley, NY (US); Kenneth John McCullough, Fishkill, NY (US); Wayne Martin Moreau, Wappingers Falls, NY (US); John P. Simons, Wappingers Falls, NY (US); Charles J. Taft, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 65 days.

(21) Appl. No.: 09/903,880

(22) Filed: Jul. 12, 2001

(65) Prior Publication Data

US 2003/0010363 A1 Jan. 16, 2003

(51) Int. Cl.[7] ..... B44C 1/22

(52) U.S. Cl. ..... 216/58; 156/345.33; 156/345.55; 438/708

(58) Field of Search ..... 156/345.33, 345.55; 216/58; 438/708

(56) References Cited

U.S. PATENT DOCUMENTS 5,076,877 A * 12/1991 Ueda et al. ..... 156/345.55

* cited by examiner

*Primary Examiner*—William A. Powell
(74) *Attorney, Agent, or Firm*—Scully, Scott, Murphy & Presser; Daniel P. Norris, Esq.

(57) ABSTRACT

Fixtures and methods for clamping workpieces in a workplace to enable the optimized exposure thereof to a stream or flow of a supercritical fluid. Provided is a rotatably indexable chuck or locator mounting the workpiece and enabling orientating the latter in specific static pitch position within a high pressure vessel in order to subject the workpiece to a full frontal exposure to the supercritical fluid stream within the vessel. This mounting arrangement facilitates an optimum positioning of the workpiece being processed in the flow path of the supercritical fluid stream while oriented in selectively indexed rotational positions.

22 Claims, 1 Drawing Sheet

FIXTURES FOR PROCESSING A WORKPIECE IN A SUPERCRITICAL FLUID

BACKGROUND OF THE INVENTION

1. Field of the Invention

The present invention relates to fixtures for the processing of workpieces in a supercritical fluid, and more particularly relates to fixture and methods for clamping workpieces in a workplace to enable the optimized exposure thereof to a stream or flow of a supercritical fluid.

2. Discussion of the Prior Art

In the technology of producing articles or workpieces, such as semiconductor devices which may have film layers applied thereto, is frequently necessary to process these in a workplace incorporating an environment constituted of supercritical fluids, wherein a surface or surfaces of the workpiece is or are exposed to a flow or stream of the supercritical fluid, and in which it is vital that the film and/or the workpiece is suitably protected from any possible damage or destruction.

Concerning the foregoing, the workpiece may be arranged in a suitable pressure vessel under a high-pressure condition, wherein the workpiece is then exposed to the stream or flow of the supercritical fluid. However, difficulties have been encountered in being able to arrange the workpieces in an optimized orientation relative to the fluid flow or stream of the supercritical fluid to which they are exposed in the pressure vessel.

SUMMARY OF THE INVENTION

Accordingly, in order to be able to take full advantage of the streams or flow directions of the supercritical fluids within the pressure vessel which impinge against the surface (or surfaces) of the workpiece, pursuant to the present invention there are provided novel and unique workplace fixtures employing in processing a workpiece in the supercritical fluid medium which affords the greatest degree of efficiency and efficacy in the treatment of the workpiece.

On the one hand, pursuant to a first embodiment of the invention, there may be provided a rotatably indexable chuck or locator mounting the workpiece and enabling orientating the latter in specific static pitch position within a high pressure vessel in order to subject the workpiece to a full frontal exposure to the supercritical fluid stream within the vessel. This mounting arrangement facilitates a film-protective treatment of the workpiece being processed in the flow path of the supercritical fluid stream while oriented in selectively indexed rotational positions.

Pursuant to another embodiment of the invention, a mounting fixture in the chamber of the pressure vessel may comprise a cup-shaped holder for receiving the workpiece, which facilitates the latter to be loaded thereon and immersed in the supercritical fluid or liquid. Suitable orifices in the chamber are provided to be enable excess liquid to drain off the workpiece down to a point whereby any forces are equalized, such as the surface tension, which will maintain the workpiece in an immersed condition while minimizing the amount of liquid which is to be processed through the pressure vessel.

Accordingly, it is a primary object of the present invention to provide a workplace incorporating a workpiece mounting fixture which will facilitate the processing of the workpiece in a supercritical fluid.

Another object of the present invention is to provide a novel workpiece mounting fixture which will facilitate the rotatably adjustable indexed positioning of the workpiece within the chamber of a high-pressure vessel while being subjected to a flow of a supercritical fluid enabling the processing or treatment thereof.

Yet another object of the present invention is to provide a workplace including a fixture in a high-pressure vessel in which a workpiece is adapted to be contained in a holder enabling excess amounts of a supercritical liquid to be drained to impart a balancing of surface tensions so as to maintain the workpiece in a immersed condition while minimizing the quantity of the liquid to be processed.

A still further object of the invention resides in the provision of methods of implementing the utilization of the above-mentioned fixtures processing workpieces in a supercritical fluid or liquid in a pressurized environment so as to facilitate the efficacious and efficient processing thereof.

BRIEF DESCRIPTION OF THE ACCOMPANYING DRAWINGS

Reference may now be made to the following detailed description of preferred embodiments of the invention, taken in conjunction with the accompanying drawings in which.

DETAILED DESCRIPTION OF PREFERRED EMBODIMENTS

Figure 1:
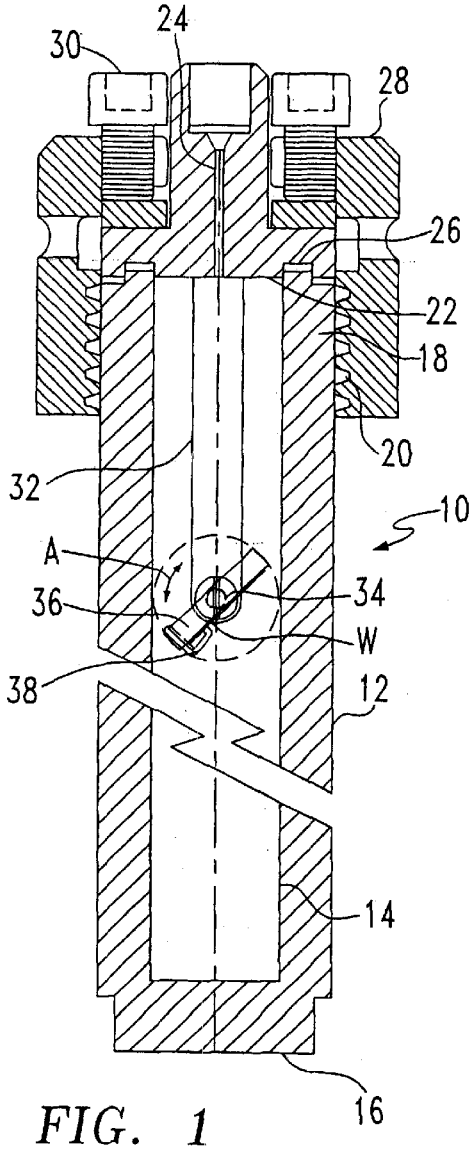
FIG. 1 illustrates a longitudinal sectional view of a high pressure vessel incorporating an inventive fixture for mounting workpieces for optimized exposure to a stream or flow of a supercritical fluid.
Figure 2:
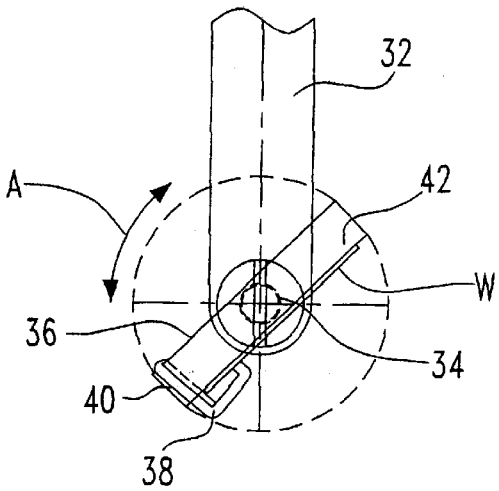
FIG. 2 illustrates an enlarged detail view of the workpiece mounting portion of the fixture of FIG. 1.

Referring now in specific detail to the drawings, and particularly the embodiments shown in FIGS. 1 and 2 thereof, FIG. 1 illustrates a vessel 10 having an elongated cylindrical wall portion 12 and constituting a high-pressure container which possesses a hollow cylindrical interior or chamber 14 and a closed bottom 16. The vessel 10 is preferably constructed from a high-strength metallic material which is able to resist extremely high internal operating pressures.

The upper end 18 of the cylindrical wall portion 12 of the vessel 10 is provided with an external screwthread 20 so as to be able to engagingly receive a screwthreaded cover structure 22 which has a narrow orifice 24 drilled therethrough communicating with chamber 14, and forms a connection to an infeed source (not shown) for a supercritical fluid. The entire vessel 10 and the cover structure 22, when mounted thereon in a sealed relationship through the interposition of an annular gasket seal or O-ring 26, may be attached to a support plate 28 of an apparatus (not shown) and fastened thereto by means of suitable screws or threaded bolts 30.

Extending downwardly within the interior chamber 14 of the high-pressure vessel 10 in coaxial relationship with the longitudinal center axis of internal cylindrical chamber 14 is an elongated rod-like rib member 32 extending downwardly into a position which is somewhat centrally located within the cylindrical chamber 14, and which includes a shaft element 34 rotatable about a transverse axis proximate the lower free end of member 32. Rotatably journaled on the shaft element 34 about a transverse axis in the direction of double-headed arrow A, as also shown in more extensive detail in FIG. 2, is a workpiece mounting member 36. This member 36 may be a plate like locator or chuck structure, having a clamping device 38 pivotably fastened to one end 40 thereof so as to be able to firmly clamp a workpiece W against a surface 42 thereof.

The workpiece W is retained in position by the clamping device 38 which also clamps the workpiece positioning plate or locator structure 36 in position.

As illustrated in FIGS. 1 and 2 of the drawings, the workpiece mounting member 36, together with the workpiece W and the clamping device 38 by means of which they are fastened, may be rotated conjointly in either direction of arrow A until the surface 42 of the member 36 mounting the workpiece W, the surface of the latter of which may have a film for processing located thereon, is indexed into a suitable angular position for processing thereof to a desired exposure angle or orientation relative to the stream or flow of a supercritical fluid being introduced into the chamber 14 through the orifice 24 under a high superatmospheric pressure.

After the rotatably indexable fixture which comprises the mounting member 36, shaft element 34 and clamping device 38, has been oriented in its desired angular alignment relative to the longitudinal axis of the chamber 14 of the high-pressure vessel 10, suitable latching means (not shown) operatively associated with the shaft element 34, may lock it to the mounting member 36 in a predetermined fixed angular position. Thereafter, the vessel cover structure 22 may be sealingly secured to the vessel body, and a stream of supercritical fluid injected into chamber 14 through the inlet orifice 24 at the upper or head end of the pressure vessel 10, in a manner well known in the technology.

Figure 3:
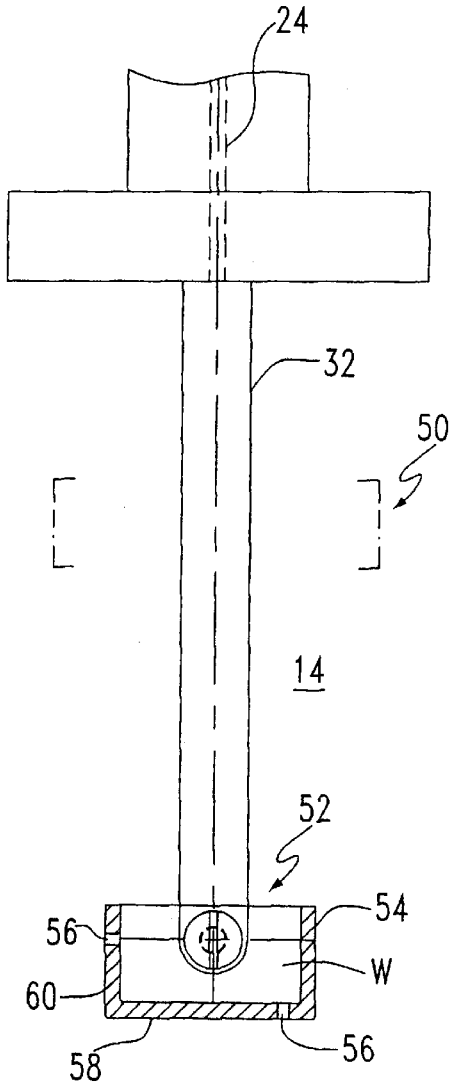
FIG. 3 illustrates a modified embodiment of a cup-shaped holder for workpieces adapted to be utilized in the fixture for processing the workpieces in a supercritical fluid.

Referring to FIG. 3 of the drawings, illustrating a second embodiment of the invention, wherein there may be utilized a pressure vessel 50 analogous with or similar to that employed in connection with the embodiment of FIGS. 1 and 2, and wherein components which are similar thereto or identical therewith are identified by the same reference numerals. In this instance, rather than having the rotatable workpiece the mounting fixture as shown in FIG. 1, mounting member or the fixture 52 which is rotatably connected to free or the bottom end of the vertical rib member 32 extending downwardly within the chamber 14 of the pressure vessel 50, is comprised of a cup-shaped holder 54 for receiving a workpiece W. The cup-shaped holder 54 may be provided with suitable apertures 56 selectively extending through, respectively, the bottom 58 and side walls 60 thereof, and in which the processing with the supercritical fluid is effected in, essentially the same mode as referred to hereinabove.

However, in this instance wherein the workpiece holder 54 is cup-shaped, in contrast with the embodiment of FIGS. 1 and 2, in which the workpiece W is typically immersed in a supercritical fluid and co-solvent mixtures in effecting process steps, it is desirable to utilize the transfer to the supercritical fluid processing by maintaining a limited amount of fluid coating. This basically enables the continuation of fluid coating through the intermediary of surface tension effects. The limiting control is provided by means of the apertures 56 or so-called weep holes which are formed in respectively, the bottom and side wall 58, 60 of the cup-shaped workpiece holder 54 and enabling excess supercritical fluid to be stream out therethrough. In essence, once the workpiece W is loaded in the cup-shaped holder 54 and the fixture is inserted and retained in the pressure vessel 50, in that the entire assembly including its mounting and being rotatably oriented on the vertical rib member 32, with the vessel then being sealed and secured as described in connection with FIGS. 1 and 2, the flow of the supercritical fluid under high pressure into the high pressure vessel 50 can them commence through the orifice 24 provided in the vessel cover structure 22, as is known in the technology and the processing of the workpiece W can be initiated as required.

From the foregoing it thus becomes readily apparent that the embodiments of present invention provide for unique and highly advantageous fixtures for processing workpieces under high pressure in a supercritical or pressurized fluid and possible co-solvent mixture flow or stream which will be protective of any film located on the workpiece W and resultingly inhibit any damage thereto during processing.

While the invention has been particularly shown and described with respect to preferred embodiments thereof, it will be understood by those skilled in the art that the foregoing and other changes in form and details may be made therein without departing from the spirit and scope of the invention.

What is claimed is:

1. A fixture for optimizing the processing of workpieces exposed to a supercritical fluid; comprising:

a pressure vessel having a sealable chamber including sidewalls and a closed bottom end wall;

a closure member fastenable to an upper end of said vessel for sealingly closing said chamber; said closure member having an orifice communicating with said chamber;

an elongated rod member attached to said closure member so as to extend downwardly into said chamber in spaced relationship from said sidewalls and bottom end wall; an article-supporting fixture being mounted at a lower free end of said elongated rod members, said workpieces being supported on said fixture in angular orientations facing said orifice; and means for introducing a supercritical fluid under high pressure into said chamber through said orifice toward said fixture so as to subject the surfaces of said workpieces to a flow of said supercritical fluid.

2. A fixture as claimed in claim 1, wherein said elongated rod member comprises a rigid ribbed structure extending centrally within said chamber.

3. A fixture as claimed in claim 1, wherein said article-supporting fixture is mounted on said elongated rod member so as to be rotatably adjustable in angularly indexed positions relative to the direction of flow of said supercritical fluid.

4. A fixture as claimed in claim 3, wherein said article-supporting fixture comprises a plate-shaped locator rotatably journaled about a shaft on said elongated rod member.

5. A fixture as claimed in claim 4, wherein a clamping structure fixedly mounts workpieces on said locator and concurrently retains said locator in an angularly fixed position relative to the longitudinal axis of said elongated rod member.

6. A fixture as claimed in claim 5, wherein said locator is retainable to said elongated rod member in a plurality of rotationally indexed positions relative to the longitudinal axis of said elongated rod member during said workpieces being treated by said supercritical fluid.

7. A fixture as claimed in claim 3, wherein said article-supporting fixture comprises a cup-shaped structure having said workpieces retained therein during treatment by said supercritical fluid.

8. A fixture as claimed in claim 7, wherein said cup-shaped structure is rotationally adjustable relative to said elongated rod member into a plurality of indexed positions so as to optimize exposure of workpiece surfaces to said supercritical fluid.

9. A fixture as claimed in claim 7, wherein said cup-shaped structure includes at least one apertured wall to facilitate the flow of supercritical fluid therethrough during treatment of said workpieces arranged in said structure.

10. A fixture as claimed in claim 1, wherein said closure member is sealingly engaged with said pressure vessel through cooperative screwthreads being formed on said closure member and an exterior surface of said sidewalls of the pressure vessel.

11. A fixture as claimed in claim 1, wherein said pressure vessel consists of a high-strength metal and has a substantially elongated cylindrical configuration.

12. A method for optimizing the processing of workpieces exposed to a supercritical fluid; comprising:

providing a pressure vessel having a sealable chamber including sidewalls and a closed bottom end wall;

fastening a closure member to an upper end of said vessel for sealingly closing said chamber; said closure member having an orifice communicating with said chamber;

an elongated rod member being attached to said closure member so as to extend downwardly into said chamber in spaced relationship from said sidewalls and bottom end wall; an article-supporting fixture being mounted at a lower free end of said elongated rod members, said workpieces being supported on said fixture in angular orientations facing said orifice; and introducing a supercritical fluid under high pressure into said chamber through said orifice toward said fixture so as to subject the surfaces of said workpieces to a flow of said supercritical fluid.

13. A method as claimed in claim 12, wherein said elongated rod member comprises a rigid ribbed structure extending centrally within said chamber.

14. A method as claimed in claim 12, wherein said article-supporting fixture is mounted on said elongated rod member so as to be rotatably adjustable in angularly indexed positions relative to the direction of flow of said supercritical fluid.

15. A method as claimed in claim 14, wherein said article-supporting fixture comprises a plate-shaped locator rotatably journaled about a shaft on said elongated rod member.

16. A method as claimed in claim 15, wherein a clamping structure fixedly mounts workpieces on said locator and concurrently retains said locator in an angularly fixed position relative to the longitudinal axis of said elongated rod member.

17. A method as claimed in claim 16, wherein said locator is retainable to said elongated rod member in a plurality of rotationally indexed positions relative to the longitudinal axis of said elongated rod member during said workpieces being treated by said supercritical fluid.

18. A method as claimed in claim 14, wherein said article-supporting fixture comprises a cup-shaped structure having said workpieces retained therein during treatment by said supercritical fluid.

19. A method as claimed in claim 18, wherein said cup-shaped structure is rotationally adjustable relative to said elongated rod member into a plurality of indexed positions so as to optimize exposure of workpiece surfaces to said supercritical fluid.

20. A method as claimed in claim 18, wherein said cup-shaped structure includes at least one apertured wall to facilitate the flow of supercritical fluid therethrough during treatment of said workpieces arranged in said structure.

21. A method as claimed in claim 12, wherein said closure member is sealingly engaged with said pressure vessel through cooperative screwthreads being formed on said closure member and an exterior surface of said sidewalls of the pressure vessel.

22. A method as claimed in claim 12, wherein said pressure vessel consists of a high-strength metal and has a substantially elongated cylindrical configuration.

* * * * *